United States Patent [19]

Houghton

[11] Patent Number: 4,483,822

[45] Date of Patent: Nov. 20, 1984

[54] NICKEL ALLOY

[75] Inventor: LeRoy H. Houghton, Toledo, Ohio

[73] Assignee: Champion Spark Plug Company, Toledo, Ohio

[21] Appl. No.: 406,034

[22] Filed: Aug. 6, 1982

[51] Int. Cl.[3] ..... C22C 19/03

[52] U.S. Cl. ..... 420/456

[58] Field of Search ..... 420/456, 459; 148/409, 148/426

[56] References Cited

U.S. PATENT DOCUMENTS 4,081,710 3/1978 Heywood et al. ..... 313/141

*Primary Examiner*—R. Dean

*Attorney, Agent, or Firm*—John C. Purdue

[57] ABSTRACT

An alloy useful for producing massive spark plug center electrodes is disclosed. The alloy consists essentially of from 0.9 to 1.5 percent of ruthenium, from 0.9 to 1.5 percent of manganese, and from 97 to 98.2 percent of nickel. Preferably, the alloy additionally contains 1 percent of silicon. The optimum alloy consists essentially of substantially 1 percent of each of Ru, Mn, and Si, balance Ni.

3 Claims, No Drawings

NICKEL ALLOY

BACKGROUND OF THE INVENTION

1. Field of the Invention

This invention relates to a nickel alloy containing small amounts of ruthenium and manganese and, optionally, a small amount of silicon.

Spark plug electrodes, in service, are subject to both corrosion and erosion. The former is caused by chemical attack while the latter is a result of spark discharge. Less effective spark plug performance and eventual spark plug failure can be the ultimate consequences of corrosion and erosion.

2. Description of the Prior Art

Precious metals have been used in a variety of ways to reduce corrosion and erosion of both massive spark plug center electrodes, diameter at the firing end in the vicinity of one tenth of an inch, and fine wire spark plug center electrodes, diameter at the firing end in the vicinity of a few hundredths of an inch. Such precious metals as gold, osmium, iridium, ruthenium, palladium, rhodium, platinum, and the like have been utilized as inserts in less expensive base metal, massive, center electrodes. (See, for example, U.S. Pat. Nos. 3,146,370, 3,407,326, and 3,691,419.) Such electrodes are expensive because they require a relatively large quantity of precious metals in order to achieve a significant increase in service life. Moreover, such electrodes are unduly susceptible to corrosion, particularly at the interface of the base metal and the precious metal. Fine wire center electrodes having firing tips made entirely of precious metals such as ruthenium, platinum, and iridium have been suggested also. (See, for example, U.S. Pat. Nos. 3,315,113 and 3,548,239.) Finally, massive center electrodes coated with an oxidation and erosion resistant metal or metal alloy have been suggested. (See, for example, U.S. Pat. Nos. 3,958,144 and 3,984,717.)

An alloy has been described (U.S. Pat. No. 4,081,710), in which Co or Ni predominates, and is alloyed or compounded with Ru, Rh, Pd, Ir, Pt, Ag or Au or combinations thereof. The amount of precious metal required is disclosed as being between a trace and 20 percent by weight of the alloy. The preferred precious metal is platinum in an amount of 1 to 20 percent by weight.

BRIEF DESCRIPTION OF THE INVENTION

The instant invention is based on the discovery of an improved alloy which is particularly useful as a massive spark plug center electrode because it is unexpectedly resistant to corrosion. The alloy consists essentially of nickel, ruthenium and manganese in certain proportions. The alloy may also include a small amount of silicon.

Accordingly, it is an object of this invention to provide an improved alloy useful as a massive spark plug center electrode.

Other objects and advantages will be apparent from the detailed description which follows, which is intended only to illustrate and disclose, but in no way to limit the invention as defined in the appended claims.

DEFINITION

The terms "percent" and "parts" are used herein and in the appended claims to refer to percent and parts by weight, unless otherwise indicated.

DETAILED DESCRIPTION OF THE INVENTION

An improved alloy of the present invention, useful as a spark plug electrode, consists essentially of from 0.9 to 1.5 percent of ruthenium, from 0.9 to 1.5 percent of manganese, and from 97 to 98.2 percent of nickel. Preferred alloys additionally contain substantially 1 percent of silicon. An optimum alloy consists essentially of substantially 1 percent of ruthenium, 1 percent of manganese, 1 percent of silicon and 97 percent of nickel.

An alloy of the instant invention can be produced by conventional powder metallurgical techniques from nickel, ruthenium, manganese and silicon powders, in suitable proportions. Preferably, however, the alloy is produced by a melt process, wherein, for example, powdered ruthenium, manganese and silicon are compressed into a billet which is added to molten nickel. Spark plug electrodes fabricated from alloys of the invention which are produced by a melt process have been found to be somewhat more resistant to corrosion than electrodes fabricated from alloys of the same composition, but produced by powder metallurgy. It has been observed that the crystal structure of the alloy of the instant invention produced by powder metallurgical techniques sometimes is, initially, heterogeneous. However, when a spark plug electrode is made from such a heterogeneous alloy and a spark plug incorporating the electrode is operated for approximately three minutes in an internal combustion engine, scanning electron microscopy indicates that the alloy has become homogeneous. It will be appreciated, therefore, that a spark plug electrode can be fabricated from an alloy according to the invention which is either heterogeneous or homogeneous. Spark plug electrodes produced from the previously identified optimum alloy according to the invention, consisting essentially of substantially 1 percent ruthenium, 1 percent manganese, 1 percent silicon, and 97 percent nickel, have been found to have excellent resistance to corrosion.

EXAMPLE I

A nickel alloy was produced by a largely conventional melt procedure from 227 g. ruthenium metal powder, 227 g. manganese metal powder, 227 g. silicon metal powder and 22.02 kg. substantially pure nickel metal. A substantially right circular cylindrical billet having a diameter of 12.7 mm. and a length of 12.7 cm. was formed by isostatic pressing of the ruthenium, manganese, and silicon powders, 207 N/cm$^2$. The nickel was melted in air at a temperature of about 1500 degrees C. in an induction furnace, after which the ruthenium/manganese/silicon billet was charged into the molten nickel. The melt was mixed for about 5 minutes to assure uniformity; ingots were then cast from the melt. A cylindrical rod substantially 6.4 mm. in diameter was then produced by hot rolling one of the billets after which the rod was cold-drawn into wire having a nominal diameter of 1.8 mm. Short lengths of the wire were then headed and welded to complementary base metal parts to produce center electrodes.

Six spark plugs were fabricated from center electrodes produced as described above, with the nickel alloy of the invention in spark gap relationship with a conventional nickel alloy ground electrode. The spark plugs were tested in a conventional six-cylinder automotive engine, which was operated on a test cycle for a total of 150 hours. The test cycle involved running the engine for 5 minutes at idle (600 r.p.m., no load) followed by 55 minutes at wide-open throttle (3200 r.p.m., under load). The spark advance was adjusted so that thermocouple spark plugs, which had a heat range similar to that of the test plugs, operated at an average electrode tip temperature of 845 degrees C. A standard automotive test fuel (containing 2 ml. per gallon of tetraethyl lead) and solid wire ignition cables were used; the spark plugs were rotated from cylinder to cylinder every ten hours. After the test, the alloy according to the invention was examined by microscopy.

EXAMPLE II

Additional alloys were produced by the procedure described above, with the exception that the proportions of alloying constituents were varied. The alloy compositions are set forth below:

| Comparative Procedure | Example | Composition |
|---|---|---|
| A | — | 0.5% Ru, 1% Mn, 1% Si and 97.5% Ni; |
| — | II | 1.5% Ru, 1% Mn, 1% Si and 96.5% Ni; |
| B | — | 2% Ru, 1% Mn, 1% Si and 96% Ni; |
| C | — | 3% Ru, 1% Mn, 1% Si and 95% Ni. |

Six spark plugs were produced from center electrodes fabricated from each of the alloys identified above; apart from the alloy compositions the spark plugs were identical to those of Example I. These spark plugs were engine-tested using substantially the equipment and procedure previously described, with the exception that the compositions of Example II and Procedure A were engine-tested for 140 hours. The alloys identified above were examined by microscopy.

The alloy of Example I was found to show the least amount of corrosion. The alloys of Procedures A and C were badly corroded. The corrosion of the alloys of Example II and of Procedure B was intermediate, the latter being substantially more corroded than the former. The corrosion of the alloys of Procedures A, B and C indicates that they are undesirable electrode materials, while the limited corrosion of the alloys of Examples I and II indicates that they are excellent electrode materials.

EXAMPLE III

Several nickel alloy billets were produced from a uniform blend of 10 parts ruthenium metal powder, 10 parts manganese metal powder, 10 parts silicon metal powder, 970 parts nickel metal powder and one part paraffin as a temporary binder. Right circular cylindrical preforms were pressed isostatically, about 207 $N/cm^2$, from the powder blend. The preforms were approximately 12.7 mm. in diameter by 12.7 cm. in length. The preforms were sintered in a cracked ammonia atmosphere for approximately 90 minutes at temperatures between about 1090 and 1320 degrees C. The sintered preforms were then reduced by hot-working to a diameter of about 11.1 mm. at a maximum temperature of about 590 degrees C. The hot-worked preforms were then refired for approximately 90 minutes at about 1090 degrees C. in a cracked ammonia atmosphere, after which cylindrical rods having diameters of substantially 6.4 mm. were produced therefrom by hot-working at about 590 degrees C. Wires were produced by cold-drawing the rods to nominal diameters of 1.8 mm. Short lengths of the wire were then headed and welded to complementary base metal parts to produce center electrodes.

Six spark plugs were fabricated from center electrodes produced as described above, with the Example III alloy in spark gap relationship with a conventional nickel alloy ground electrode. The spark plugs were engine-tested using substantially the equipment and procedure described in Example I. The procedure differed in two respects: (1) the spark advance was adjusted so that thermocouple spark plugs which had a heat range similar to the test plugs operated at an average electrode tip temperature of 790 degrees C. and (2) the plugs were tested for 150 hours. The spark plugs were then taken out of the engine and the Example III alloy was examined by microscopy.

EXAMPLE IV

Additional alloys were produced by the procedure described in Example III, with the exception that the proportions of alloying constituents were varied. The alloy compositions are set forth below:

| Comparative Procedure | Example | Composition |
|---|---|---|
| D | — | 1% Ru, 99% Ni; |
| E | — | 2% Ru, 98% Ni; |
| F | — | 3% Ru, 97% Ni; |
| G | — | 1% Ru, 0.5% Mn, 98.5% Ni; |
| — | IV | 1% Ru, 1% Mn, 98% Ni. |

Six spark plugs were produced from center electrodes fabricated from each of the alloys identified above; apart from the alloy compositions, the spark plugs were identical to those of Example III. These spark plugs were subjected to the engine-testing described in Example III, with the exception that they were engine-tested for 200 hours. The alloys were then examined by microscopy.

The alloy of Example III was found to show slightly less corrosion than that of Example IV.

Of the alloys which contained no manganese, that of Procedure D was found to show the least amount of corrosion. The alloys of Procedures E and F were badly corroded, the latter more so than the former. The corrosion exhibited by the alloys of Procedures D through F indicates that they are undesirable electrode materials.

The alloy of Example IV was found to show much less corrosion than the alloy of Procedure G. By comparison with the alloy of Example III, the alloy of Example IV was inferior in terms of corrosion resistance; both alloys, however, are excellent electrode materials. The corrosion of the alloy of Procedure G indicates that it is undesirable as an electrode material.

A comparison of photomicrographs of the alloys of Examples I and III indicates that the former is more corrosion resistant. Since the proportions of alloy constitutents were identical in Examples I and III, the enhanced corrosion resistance of the former has been attributed to the preferred melt procedure of Example I.

In view of the foregoing observations and conclusions, it is apparent that nickel, manganese and ruthenium are essential elements of the corrosion resistant alloy of the instant invention. Moreover, the test data indicates that ruthenium and manganese significantly increase the corrosion resistance of a nickel alloy, only when they are present in amounts at least approaching 1%, i.e. 0.9% and above. When either manganese or ruthenium is present in a nickel alloy in an amount greater than about 1.5 percent, such an alloy will be unduly susceptible to grain boundary corrosion and, therefore, undesirable as an electrode material. In addition, 1% of silicon materially enhances the corrosion resistance of a nickel alloy containing from 0.9 to 1.5% of each of manganese and ruthenium.

Although the invention and preferred embodiments thereof have been described, it is intended that this description only illustrate and disclose, and that the invention not be limited except by the definitions in the following claims.

What I claim is:

1. An alloy consisting essentially of from 0.9 to 1.5 percent of ruthenium, from 0.9 to 1.5 percent of manganese, and 97 to 98.2 percent of nickel.

2. An alloy as claimed in claim 1 which additionally contains substantially 1 percent of silicon.

3. An alloy as claimed in claim 1 consisting essentially of substantially 1 percent of ruthenium, 1 percent of manganese, 1 percent of silicon, and 97 percent of nickel.

* * * * *